US009373468B2

(12) United States Patent
Priest

(10) Patent No.: US 9,373,468 B2
(45) Date of Patent: Jun. 21, 2016

(54) ARC CONTROL FOR CONTACTOR ASSEMBLY

(71) Applicant: TYCO ELECTRONICS CORPORATION, Berwyn, PA (US)

(72) Inventor: Marcus Priest, Carpinteria, CA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 1 day.

(21) Appl. No.: 14/487,706

(22) Filed: Sep. 16, 2014

(65) Prior Publication Data

US 2016/0079017 A1 Mar. 17, 2016

(51) Int. Cl.
*H01H 33/18* (2006.01)
*H01H 33/08* (2006.01)

(52) U.S. Cl.
CPC ..... *H01H 33/182* (2013.01); *H01H 33/08* (2013.01); *H01H 33/18* (2013.01)

(58) Field of Classification Search
CPC ..... H01H 2050/025; H01H 33/6662; H01H 50/60; H01H 1/54; H01H 33/38; H01H 3/28
See application file for complete search history.

(56) References Cited

U.S. PATENT DOCUMENTS 4,367,448 A * 1/1983 Nishizako ..... H01H 9/443 218/26
4,559,511 A * 12/1985 Basnett ..... H01F 7/08 218/140
5,132,497 A * 7/1992 Moldovan ..... G01R 1/18 218/23
5,519,370 A * 5/1996 Perreira ..... H01H 3/001 218/123
5,646,386 A * 7/1997 Yorita ..... H01H 33/6644 218/129
5,818,003 A 10/1998 Moldovan et al.
5,892,194 A * 4/1999 Uotome ..... H01H 1/34 218/68
6,064,024 A 5/2000 Moldovan
6,480,082 B1 * 11/2002 Aihara ..... H01H 1/2058 200/295
6,756,868 B2 * 6/2004 Sato ..... H01H 50/38 218/155
8,232,499 B2 7/2012 Bush et al.
8,446,240 B2 5/2013 Swartzentruber et al.
8,653,913 B2 2/2014 Vellaiyanaicken et al.
2008/0030289 A1 2/2008 Kralik
2013/0063232 A1 3/2013 Takaya et al.

FOREIGN PATENT DOCUMENTS

JP 2007 123058 A 5/2007

OTHER PUBLICATIONS

International Search Report, International Application No. PCT/2015/050076, International Filing Date, Sep. 15, 2015.

* cited by examiner

*Primary Examiner* — Truc Nguyen

(57) ABSTRACT

A contactor or switch assembly adapted for switching power to a circuit. The housing has internal walls that laterally extend within the interior compartment to define a protection chamber. Current carrying contacts are disposed in the protection chamber of the housing. The current carrying contacts include conductive bodies that protrude from the housing and are configured to close the circuit. Arc dissipation areas are provided in the protection chamber and are located proximate to the current carrying contacts. Magnets are provided proximate ends of the dissipation areas. The magnets create magnetic flux or a magnetic field that extends across the current carrying contacts. The magnetic flux directs electric arcs radiating from one or more of the current carrying contacts into the arc dissipation areas, thereby increasing the effective distance that the electric arcs travel wherein the electric arcs are dissipated in the dissipation areas.

16 Claims, 4 Drawing Sheets

ARC CONTROL FOR CONTACTOR ASSEMBLY

FIELD OF THE INVENTION

The present invention relates generally to switches for electric circuits, and more particularly to contactor assemblies with improved arc control.

BACKGROUND OF THE INVENTION

Some known electric circuits include contactors that control the flow of current through the circuit. The contactors control current flow through the circuit by opening or closing a conductive pathway that extends through the contactor to correspondingly open or close the circuit.

In circuits that convey relatively high levels of direct current, electric arcs will be generated inside the contactors when the contactor switches from a closed state to an open state to open the circuit. When the contactors change from the closed state to the open state, an electric arc will radiate from the contacts in the contactor while the current is being driven to zero by the resistance of the arc. The electric arc can be of relatively high energy. If the arc is of sufficiently high energy and time duration, the arc can damage and/or contaminate the contacts in the contactor. The arcs also can weld the contacts with one another if arcs are present during contact bouncing during the closing operation. For example, the arcs may weld the contacts together such that the contactor cannot separate the contacts to open the circuit to which the contactor is connected.

Some known contactors that are able to withstand relatively large surges of current are large, heavy and expensive to manufacture. The contactors may include relatively large contacts, actuator mechanisms and/or arc dissipation members that are heavy and/or expensive to produce. Other smaller and/or lighter contactors are unable to withstand relatively large currents due to the small contact forces combined with the placement of the arc magnets. Also, the contacts and/or arc dissipation members in these contactors are more easily damaged by the electrical arcs radiating from the contacts. Additionally, some of the contacts may be separated from one another and open the circuit when the contacts are subjected to large surge currents. The arc that emanates due to those events may result in a catastrophic arc event, or welding of contacts upon re-closure.

In some power switching contactors, arc control is facilitated by the use of permanent magnets. However, in many such devices, the magnets are placed such that the device is polarity sensitive to the interrupting current. In addition, the positioning of the permanent magnet interacts with the magnetic field of the contact such that when the contacts are closed and conducting current, the contact force is reduced beyond that due to the normal contribution of the contact spot repulsive force. U.S. Pat. No. 8,232,499 discloses contactor assembly having permanent magnets. A contactor assembly is adapted for switching power to a circuit having a power source. The contactor assembly includes a housing, carry contacts and arc contacts. The housing defines an interior compartment and includes internal chamber walls that laterally extend within the compartment to define a protection chamber. The carry contacts are disposed in the protection chamber of the housing. The arc contacts are disposed in the housing outside of the protection chamber. The internal chamber walls of the housing prevent material that is expelled from one or more of the arc contacts when an electric arc emanates from one or more of the arc contacts from contaminating one or more of the carry contacts. Magnets may be provided on opposite sides of the interior compartment alongside or adjacent to the lateral perimeter walls. The magnets create magnetic flux or a magnetic field that extends across or encompasses the arc contacts. With the magnetic flux, the flux alters the path of the arc, thereby effectively increasing the distance that the arc must travel.

While the contactor assembly of U.S. Pat. No. 8,232,499 provides adequate arc control, a need exists for a smaller, lighter and/or less expensive contactor that is able to safely turn on and off relatively large electric currents while avoiding welding and excessive arcing damage to the contacts in the contactor. In addition, there exists a need for an arc control which is insensitive to polarity and which does not result in a reduction of contact forces when the contacts are moved to the closed position.

SUMMARY OF THE INVENTION

In one embodiment, a contactor assembly adapted for switching power to a circuit having a power source includes a housing with an interior compartment. The housing has internal walls that laterally extend within the interior compartment to define a protection chamber. Current carrying contacts are disposed in the protection chamber of the housing. The current carrying contacts include conductive bodies that protrude from the housing and are configured to close the circuit. Arc dissipation areas are provided in the protection chamber of the interior compartment. The arc dissipation chambers are located proximate to the current carrying contacts. Magnets are provided proximate ends of the dissipation areas. The magnets create magnetic flux or a magnetic field that extends across the current carrying contacts. The magnetic flux from the magnets directs electric arcs radiating from one or more of the current carrying contacts into the arc dissipation areas, thereby increasing the effective distance that the electric arcs travel wherein the electric arcs are dissipated in the dissipation areas.

In another embodiment, a switch assembly adapted for switching power to a circuit having a power source is disclosed. The switch assembly includes a housing which defined an interior compartment. The housing includes internal walls that laterally extend within the interior compartment to define a protection chamber. Current carrying contacts are disposed in the protection chamber of the housing. The current carrying contacts include conductive bodies that protrude from the housing and are configured to close the circuit. Arc dissipation areas are provided in the protection chamber of the interior compartment and are located proximate to the current carrying contacts. Arcuate magnets are provided proximate ends of the dissipation areas, the magnets create magnetic flux or a magnetic field that extends across the current carrying contacts. The magnetic flux from the magnets directs electric arcs radiating from the current carrying contacts into the arc dissipation areas, wherein paths of the electric arcs approximate a parabola, thereby effectively increasing the distance that the arcs must travel.

In another embodiment, a switch assembly adapted for switching power to a circuit having a power source is disclosed. The switch assembly includes a housing which defined an interior compartment. The housing includes internal walls that laterally extend within the interior compartment to define a protection chamber. A pair of current carrying contacts are disposed in the protection chamber of the housing. The pair of current carrying contacts include conductive bodies that protrude from the housing and are configured to close the circuit. A pair of arc dissipation areas are provided at opposite ends of the protection chamber of the interior compartment. The arc dissipation chambers are located proximate to the current carrying contacts. A pair of magnets are provided proximate ends of the dissipation areas. Each magnet creates magnetic flux or a magnetic field that extends across a respective current carrying contact. The magnetic flux from the each magnet directs an electric arc radiating from the respective current carrying contact into a respective arc dissipation area, thereby increasing the effective distance that the electric arc travels wherein the electric arc is dissipated in the respective dissipation area.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
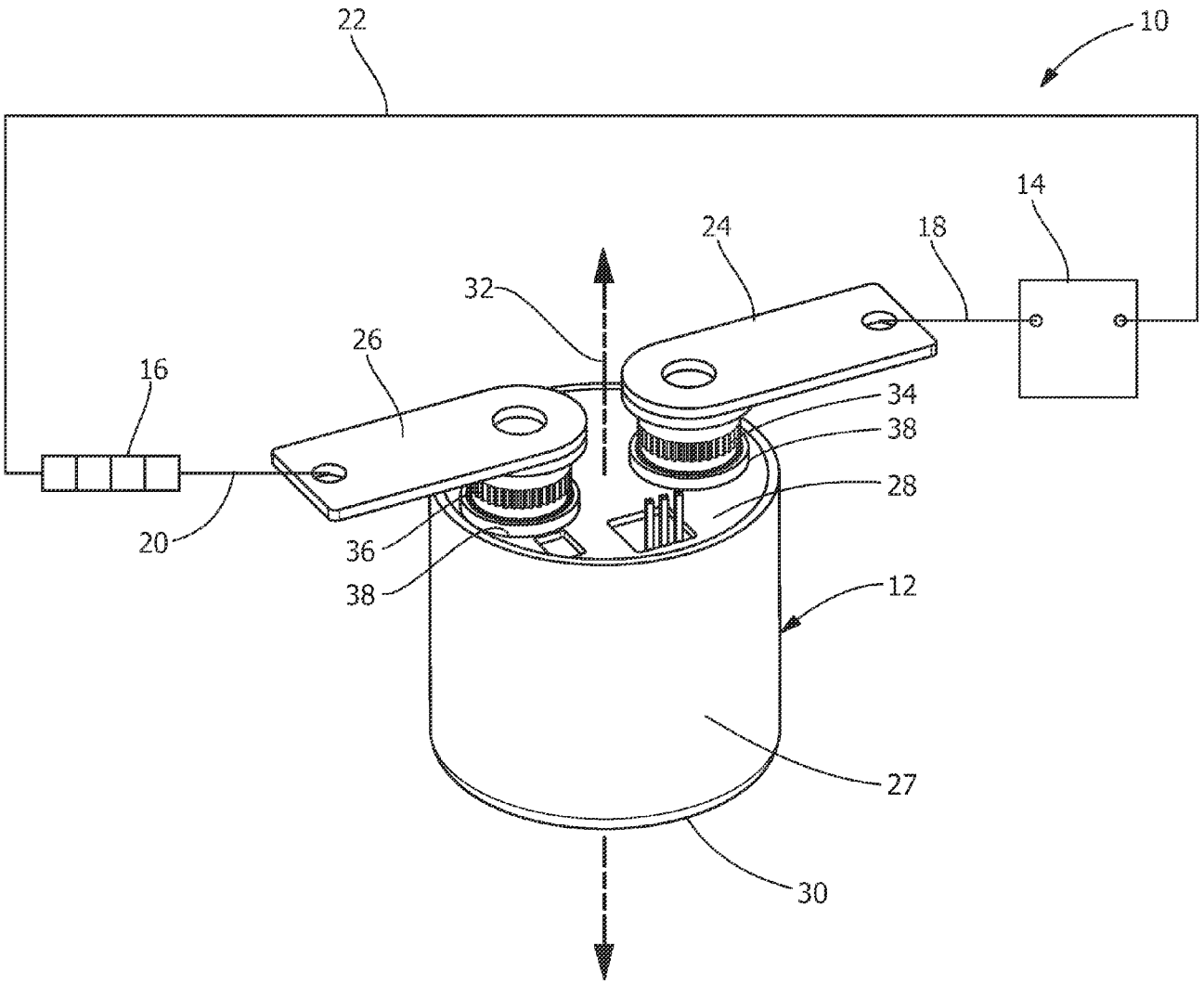
FIG. 1 is a schematic diagram of a circuit that includes a contactor assembly in accordance with one embodiment of the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combination of features that may exist alone or in other combinations of features, the scope of the invention being defined by the claims appended hereto.

FIG. 1 is a schematic diagram of a circuit 10 that includes a contactor or switch assembly 12 in accordance with one embodiment of the present disclosure. The circuit 10 includes a power source 14 that is electrically coupled with one or more electrical loads 16 via conductive pathways 18, 20, 22 and the contactor assembly 12. The power source 14 may be any of a variety of systems, devices and apparatuses that supply electric current to power the electrical load 16. For example, the power source 14 may be a battery that supplies direct current (DC) or alternating current (AC) to the electrical load 16.

Figure 6:
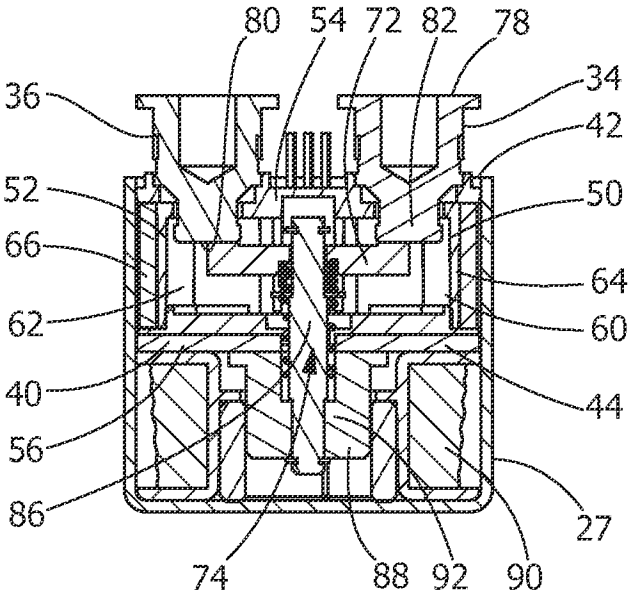
FIG. 6 is a cross-sectional view of the contactor assembly, similar to that shown in FIG. 5, in accordance with one embodiment of the present disclosure with the contactor assembly shown in a closed position.
Figure 5:
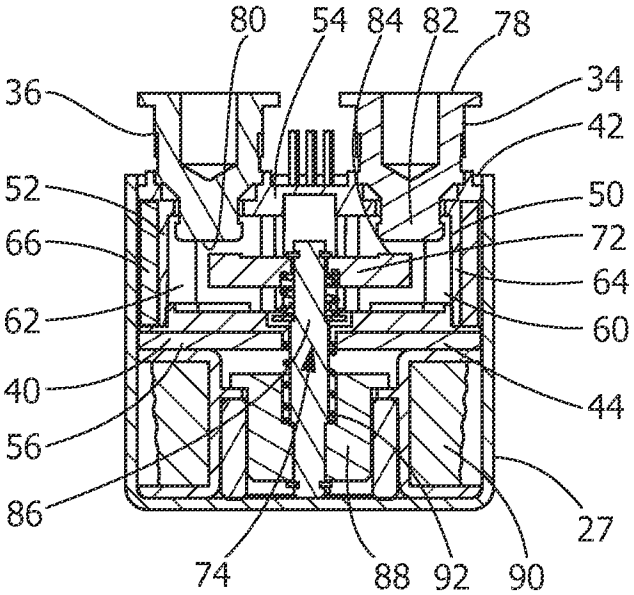
FIG. 5 is a cross-sectional view of the contactor assembly along line 5-5 shown in FIG. 2 in accordance with one embodiment of the present disclosure with the contactor assembly shown in an open position.

The conductive pathways 18, 20, 22 may include any of a variety of conductive bodies capable of transmitting electric current. For example, the conductive pathways 18, 20, 22 may include wires, cables, bus bars, contacts, connectors and the like. The contactor assembly 12 is a relay or switch that controls the delivery of power through the circuit 10. The contactor assembly 12 is joined with the power source 14 and the electrical load 16 by the conductive pathways 18, 20. In the illustrated embodiment, bus bars 24, 26 couple the conductive pathways 18, 20 with the contactor assembly 12. Alternatively, a different number of bus bars 24, 26 may be used or a different component or assembly may be used to electrically join the contactor assembly 12 with the circuit 10. The contactor assembly 12 alternates between an open state (as shown in FIG. 5) and a closed state (as shown in FIG. 6). In a closed state, the contactor assembly 12 provides a conductive bridge between the conductive pathways 18, 20, or between the bus bars 24, in order to close the circuit 10 and permit current to be supplied from the power source 14 to the electrical load 16. In the open state, the contactor assembly 12 removes the conductive bridge between the pathways 18, 20, or between the bus bars 24, such that the circuit 10 is opened and current cannot be supplied from the power source 14 to the electrical load 16 via the contactor assembly 12.

The contactor assembly 12 is shown in FIG. 1 as including an outer housing 27 that extends between opposite ends 28, 30 along a longitudinal axis 32. While the outer housing 27 is shown in the approximate shape of a cylindrical can, alternatively the outer housing 27 may have a different shape. The outer housing 27 may include, or be formed from, a dielectric material such as one or more polymers.

Figure 2:
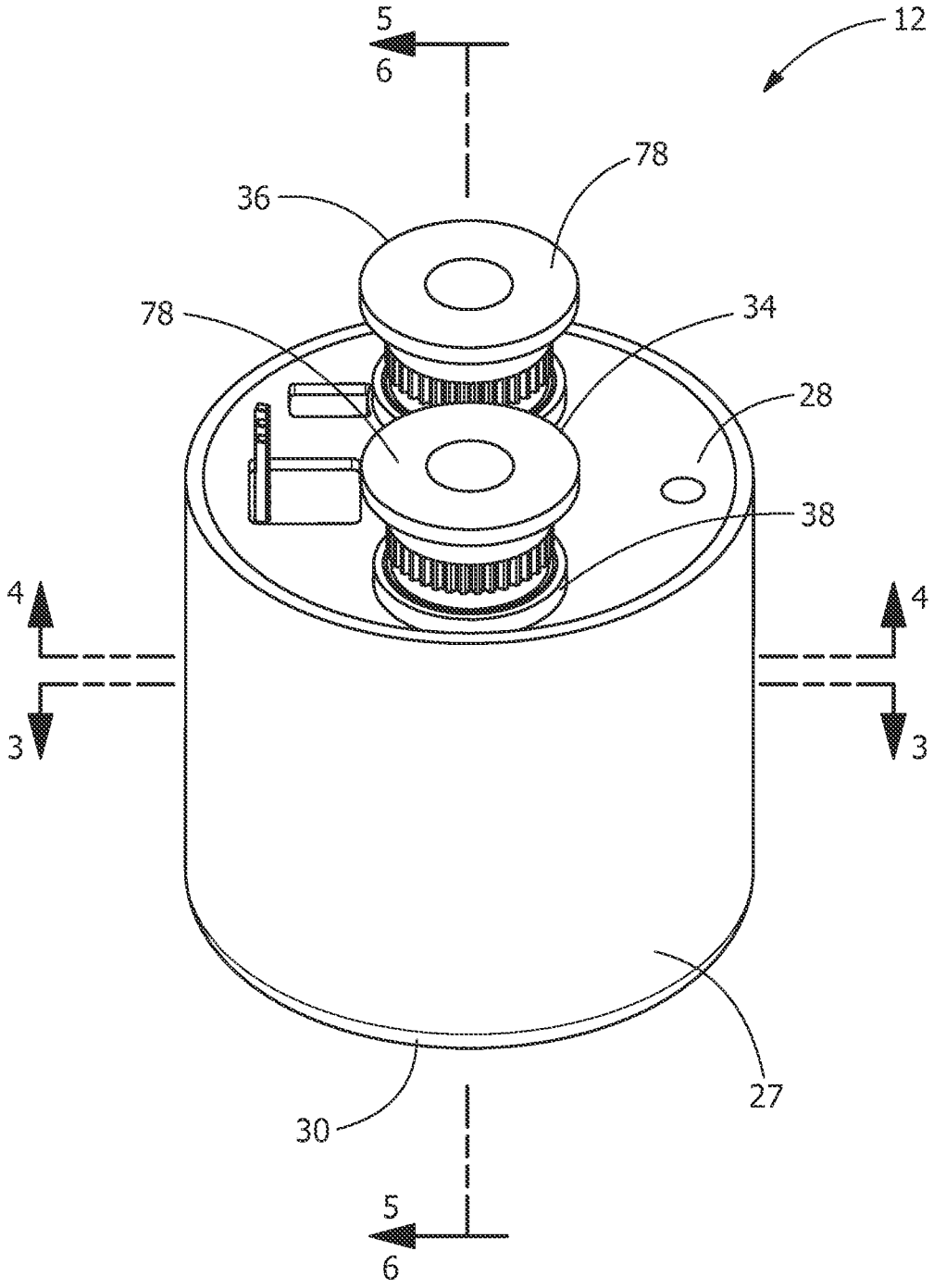
FIG. 2 is a perspective view of the contactor assembly shown in FIG. 1, with the bus bars removed.

In another embodiment, the outer housing 27 may include or be formed from conductive materials, such as one or more metal alloys. As described below, the contactor assembly 12 includes a set of current carrying contacts 34, 36 (shown in FIG. 2) that convey current through the contactor assembly 12. The contacts 34, 36 close and open the circuit 10. In one embodiment, when the contacts 34, 36 close or open the circuit 10, the initial transfer of relatively high current that is supplied by the power source 14 across the contacts 34, 36 may cause the contacts 34, 36 to arc, or create an electric arc that extends from one or more of the contacts 34, 36 within the contactor assembly 12. For example, the gas or atmosphere within the contactor assembly 12 that surrounds the contacts 34, 36 may electrically break down and permit the electric charge surging through the contacts 34, 36 to jump or move across the gas or atmosphere. The arcing may produce an ongoing plasma discharge that results from current flowing through normally nonconductive media such as the gas or atmosphere. The arcing can result in a very high temperature that may be capable of melting, vaporizing or damaging components within the contactor assembly 12, including the contacts 34, 36. In accordance with one or more embodiments described here, the contactor assembly 12 includes features that direct the electric arc away from the contacts 34, 36 and/or dissipates the electric arc such that the electric arc does not damage or contaminate the contacts 34, 36.

The end 28 of the housing 27 includes several openings 38 through which the contacts 34, 36 extend. The contacts 34, 36 extend through the openings 38 to mate with conductive bodies that are joined with the circuit 10 such as the bus bars 24, 26 (shown in FIG. 1). In the illustrated embodiment, the contact 34 mates with bus bar 24 while the contact 36 mates with bus bar 26.

Figure 3:
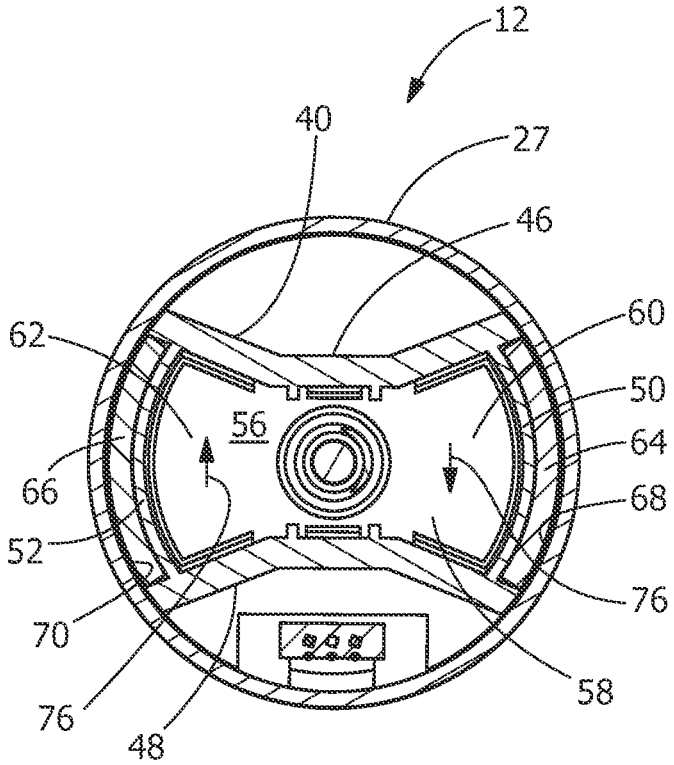
FIG. 3 is a cross-sectional view of the contactor assembly along line 3-3 shown in FIG. 2 in accordance with one embodiment of the present disclosure.
Figure 4:
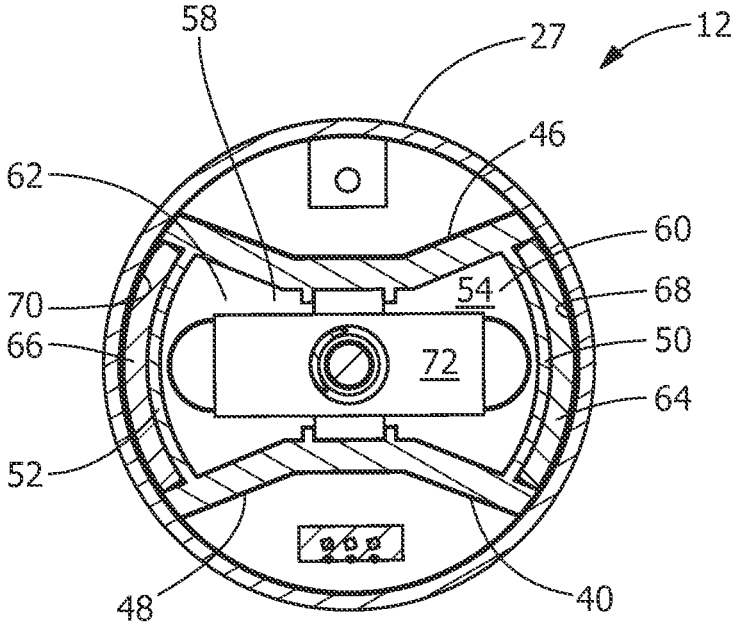
FIG. 4 is a cross-sectional view of the contactor assembly along line 4-4 shown in FIG. 2 in accordance with one embodiment of the present disclosure.

The contactor assembly 12 includes an inner housing 40 (as shown in FIGS. 3 and 4) disposed within the outer housing 27. The inner housing 40 may extend between opposite ends 42, 44, as best shown in FIGS. 5 and 6. The contacts 34, 36 protrude through the end 42 of the inner housing 40 to be presented at the end 28 of the outer housing 27. The inner housing 40 may include, or be formed from, a dielectric material such as one or more polymers.

As best shown in FIGS. 3 and 4, the inner housing 40 includes side walls 46, 48, end walls 50, 52, a top wall 54 and a bottom wall 56 that define an interior compartment 58 of the contactor assembly 12. The walls 46, 48, 50, 52, 54, 56 may include, or be formed from, a dielectric material such as, but not limited to, one or more polymers.

The side walls 46, 48 and the end walls 50, 52 may be referred to as perimeter walls and the top wall 54 and bottom wall 56 may be referred to as upper and lower walls, respectively. The perimeter walls 46-52 extend along the longitudinal axis 32 (FIG. 1) between the lower wall 56 and the upper wall 54. The perimeter walls 46-52 also extend around the periphery of the interior compartment 58. For example, in the embodiment shown, the perimeter walls 46-52 form a bowtie or butterfly shape, as viewed in FIGS. 3 and 4, with the end walls 50, 52 having an arcuate configuration. As shown in FIG. 3, portions of the perimeter side walls 46, 48 oppose one another and are located on opposite sides of the interior compartment 58. The perimeter end walls 50, 52 oppose one another and are located on opposite ends of the interior compartment 58. The perimeter side walls 46, 48 laterally extend between and interconnect or intersect the perimeter end walls 50, 52. The perimeter end walls 50, 52 transversely extend between and interconnect or intersect the perimeter side walls 46, 48. While the perimeter walls 46-52 are shown as a butterfly configuration, the walls 46-52 may have different shapes and/or be oriented differently than is shown in the illustrated embodiment.

As shown in FIG. 3, the contacts 34, 36 are disposed in the interior compartment 58. The interior compartment 58 may be sealed and loaded with an inert and/or insulating gas, such as, but not limited to, sulphur hexafluoride, nitrogen and the like. The perimeter walls 46-52 and the upper and lower walls 54, 56 enclose the contacts 34, 36 so that any electric arc extending from the contacts 34, 36 are contained within the interior compartment 58 and do not extend out of the interior compartment 58 to damage other components of the contactor assembly 12 or circuit 10 (shown in FIG. 1).

As shown in FIG. 4, the contacts 34, 36 are located in arc dissipation areas 60, 62. The arc dissipation areas 60, 62 are subsets or sections of the internal compartment 58. In the illustrated embodiment, the total volume or space of the internal compartment 58 includes the arc dissipation areas. Alternatively, one or more other chambers, compartments and the like may be provided. The arc dissipation area 60 extends between the perimeter side walls 46, 48 proximate perimeter end wall 50 and between the upper and lower walls 54, 56. The arc dissipation area 62 extends between the transverse perimeter side walls 46, 48 the proximate lateral end perimeter wall 52 and between the upper and lower walls 54, 56. The arc dissipation chambers 60, 62 are enlarged areas or pockets which are positioned on opposite sides of each contact 34, 36.

The dissipation chambers 60, 62 provide space or volume for the electric arc radiating from the contacts 34, 36 to dissipate, or "blow out." For example, an electric arc emanating from the contact 34 may be directed away from the contact 36 into chamber 60 to contain and extinguish the electric arc.

In the illustrated embodiment, curved, radiused or arcuate arc extinguishing permanent magnets 64, 66 are provided on opposite sides of the interior compartment 58 (shown in FIG. 3). In the illustrative embodiment shown, the magnets 64, 66 are inserted and maintained in magnet receiving recess 68, 70 which are formed between the inner housing 40 and the outer housing 27. For example, permanent magnets 64, 66 may be located outside of the interior compartment 58 alongside or adjacent to the lateral perimeter end walls 50, 52. Alternatively, the magnets 64, 66 may be electromagnets or other source of a magnetic flux.

The arc extinguishing permanent magnets 64, 66 are positioned proximate to or adjacent the dissipation or arc extinguishing areas 60, 62. Because the arc extinguishing permanent magnets 64, 66 are disposed proximate the end walls 50, 52 of the inner housing 40, the arc extinguishing permanent magnets 64, 66 can be positioned in close vicinity of the contacts 34, 36 and a coupling member 72 of an actuator assembly 74, as will be more fully described.

The magnets 64, 66 create magnetic flux or a magnetic field that extends across or encompasses the contacts 34, 36. For example, the magnetic polarity of the magnets 64, 66 may be aligned with one another such that magnetic flux or a magnetic field is generated extending from magnetic south to magnetic north generally along the direction of arrows 76 (FIG. 3). The magnetic flux from the magnets 64, 66 may laterally direct electric arcs radiating from one or more of the contacts 34, 36 into the arc dissipating or extinguishing areas or chambers 60, 62. For example, the magnetic flux or field created by the magnets 64, 66 may direct the electric arc away from the contacts 34, 36 and thereby increase the effective distance that the electric arc needs to travel in order to propagate or travel. The magnetic flux "blows" the arc to one side or the other of the contacts 34, 36 approximately along one or more opposing directions 76. The direction 76 in which the arc is blown or directed depends on the polarity of the current flowing through the arc. Without the magnetic flux, the electric arc typically would travel the shortest possible distance which is a straight line. With the magnetic flux, the flux directs the path of the arc to approximate a parabola, thereby effectively increasing the distance that the arc must travel. The conditions conducive to arcing may be diminished by the applied flux.

In the embodiment shown, a pair of contacts 34, 36 are shown. A pair of respective dissipation areas 60, 62 and a pair of respective magnets 64, 66 are shown proximate the pair of contacts 34, 36. However, other variations and number of contacts, dissipation areas and magnets can be provided without departing from the scope of the invention.

As best shown in FIGS. 5 and 6, the contacts 34, 36 are elongated bodies that extend between mating ends 78 and engagement ends 80. The mating ends 78 couple with the circuit 10 (shown in FIG. 1) to electrically couple the contactor assembly 12 with the circuit 10. For example, the mating ends 78 may be joined with the bus bars 24 (shown in FIG. 1). In the illustrated embodiment, the engagement ends 80 include conductive pads 82. The conductive pads 82 include, or are formed from, a conductive material such as, but not limited to, one or more metals or metal alloys. For example, the conductive pads 82 may be formed from a silver (Ag) alloy.

The use of a silver alloy may prevent the conductive pads 82 from welding to conductive pads 84 of an actuator subassembly 74.

In the illustrative embodiment shown the actuator subassembly 74 moves along or in directions parallel to the longitudinal axis 32 to electrically couple contacts 34, 36 with one another. The actuator assembly 74 includes a coupling member 72. For example, the coupling member 72 may be shaped as an elongated bar. The coupling member 72 includes, or is formed from, a conductive material such as, but not limited to, one or more metals or metal alloys. The coupling member 72 includes the conductive pads 84 on opposite ends of the coupling member 72.

The actuator subassembly 74 moves in opposing directions along the longitudinal axis 32 to move the coupling member 72 toward the contacts 34, 36 (closed position, FIG. 6) and away from the contacts 34, 36 (open position, FIG. 5). For example, the actuator subassembly 74 may move toward the engagement ends 80 of the contacts 34, 36 to lift the coupling member 72 toward the engagement ends 80.

The mating of the coupling member 72 with the contacts 34, 36 causes the actuator subassembly 74 to close the circuit 10. In the illustrated embodiment, the coupling member 72 joins the contacts 34, 36 with one another such that current may flow through the contacts 34, 36 and across the actuator subassembly 74 in either direction. The mating and unmating of the actuator subassembly 74 with the contacts 34, 36 is shown and described below in connection with one embodiment of the present disclosure.

FIG. 5 is a cross-sectional view of the contactor subassembly 12 in an open state in accordance with one embodiment of the present disclosure. The actuator subassembly 74 includes an elongated shaft 86 that is oriented along the longitudinal axis 32. The coupling member 72 is joined to the shaft 86 at one end using a clip or other known method.

As shown in FIG. 5, the contactor assembly 12 is in an open state because the actuator subassembly 74 is decoupled from contacts 34, 36. The actuator subassembly 74 is separated from the contacts 34, 36 such that the coupling members 72 do not interconnect or electrically join the contacts 34, 36 with one another. As a result, current cannot pass across the contacts 34, 36.

The actuator subassembly 74 includes a magnetized body 88 coupled to the plunger 86. The body 88 may include a permanent magnet that generates a magnetic field or flux oriented along the longitudinal axis 32. The contactor assembly 12 includes a coil body 90 that encircles the body 88. The coil body 90 may be used as an electromagnet to drive the magnetic body 88 of the shaft 86 along the longitudinal axis 32. For example, the coil body 90 may include conductive wires or other components that encircle the magnet body 88. An electric current may be applied to the coil body 90 to create a magnetic field that is oriented along the longitudinal axis 32. Depending on the direction of the current passing through the coil body 90, the magnetic field induced by the coil body 90 may have magnetic north oriented upward toward the end 28 of the outer housing 27 or downward toward the end 30.

In order to drive the actuator subassembly 74 toward the contacts 34, 36, the coil body 90 is energized to create a magnetic field along the longitudinal axis 32. The magnetic field may move the magnet body 88 of the actuator assembly 74 toward the contacts 34, 36 along the longitudinal axis 32. In the illustrated embodiment, a plunger spring 92 extends between the magnet body 88 and the lower wall 56 of the internal compartment 58. The plunger spring 92 exerts a force on the plunger 86 in a downward direction toward the end 30 of the outer housing 27. The force exerted by the plunger spring 92 prevents the actuator subassembly 74 from moving toward and mating with the contacts 34, 36 without the creation of a magnetic field by the coil body 90. The magnetic field generated by the coil body 90 is sufficiently large or strong so as to overcome the force exerted on the plunger 86 by the plunger spring 92 and drive the shaft 86 and the actuator subassembly 74 toward the contacts 34, 36.

FIG. 6 is a cross-sectional view of the contactor assembly 12 in a closed state in accordance with one embodiment of the present disclosure. In the closed state, the actuator subassembly 74 has moved within the contactor assembly 12 along the longitudinal axis 32 sufficiently far that the coupling member 72 is mated with contacts 34, 36. As a result, the actuator subassembly 74 has electrically coupled contacts 34, 36 to close the circuit 10. As the circuit 10 as described above, is opened, the magnets 64, 66 create magnetic flux or a magnetic field that extends across or encompasses the contacts 34, 36. For example, the magnetic polarity of the magnets 64, 66 may be aligned with one another such that magnetic flux or a magnetic field is generated extending from magnetic south to magnetic north generally along the direction of arrows 76. The magnetic flux from the magnets 64, 66 may laterally direct electric arcs radiating between one or more of the contacts 34, 36 and the coupling member 72 into the arc extinguishing areas or chambers 60, 62, thereby increase the effective distance that the electric arc needs to travel in order to propagate or travel. The magnetic flux "blows" the arc to one side or the other of the contacts 34, 36 approximately along one or more opposing directions 76. The direction 76 in which the arc is blown or directed depends on the polarity of the current flowing through the arc. Without the magnetic flux, the electric arc typically would travel the shortest possible distance which is a straight line. With the magnetic flux, the flux directs the path of the arc to approximate a parabola, thereby effectively increasing the distance that the arc must travel.

The magnets 64, 66 are sized to provide sufficient flux and direction to a establish a sufficient arc length to ensure that the arcs are extinguished in the dissipation or arc extinguishing areas 60, 62. The arcuate shape of the magnets 64, 66 helps to ensure that the arcs are directed to the arc extinguishing areas 60, 62, thereby facilitating that the arc develops stably and that the arc extinguishing performance is improved.

Since the arc-extinguishing permanent magnets 64, 66 are contained in the recesses 68, 70, respectively, the arc does not directly contact the arc-extinguishing permanent magnets 64, 66. Therefore, the magnetic properties of the arc-extinguishing permanent magnets 64, 66 are stably maintained to achieve stable interruption performance.

In one embodiment, the plunger 86 may continue to move along the longitudinal axis 32 toward the contacts 34, 36. In order to open the circuit 10, the actuator subassembly 74 may move in an opposite direction along the longitudinal axis 32. For example, the actuator subassembly 74 may move along the longitudinal axis 32 toward the end 30 (shown in FIG. 1) of the contactor assembly 12. The actuator subassembly 74 may move toward the end 30 by reducing the magnitude of the current passing through the coil body 90, or by eliminating the passing of current through the coil body 90. For example, the magnitude of the current may be reduced or eliminated such that the compressed plunger spring 92 drives the plunger 86 and the actuator subassembly 74 along the longitudinal axis 32 toward the end 30.

The magnets and contactor described herein provide a power switching device which is insensitive to the polarity of the interrupted current. In addition, due to the positioning of the magnets, the contactor does not have an unwanted reduction in contact force caused by the interactions of the magnetic forces. The magnet placement proximate the ends of the contact gap, rather than placed parallel to the contact bridge, allows for a more compact, efficient configuration of the contactor.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions and sizes, and with other elements, materials and components, without departing from the spirit or essential characteristics thereof. One skilled in the art will appreciate that the invention may be used with many modifications of structure, arrangement, proportions, sizes, materials and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and not limited to the foregoing description or embodiments.

The invention claimed is:

1. A contactor assembly adapted for switching power to a circuit having a power source, the contactor assembly comprising:

a housing defining an interior compartment and including internal walls that laterally extend within the interior compartment to define a protection chamber, end walls of the protection chamber having an arcuate configuration;

current carrying contacts disposed in the protection chamber of the housing, the current carrying contacts including conductive bodies that protrude from the housing and are configured to close the circuit;

an actuator assembly having a coupling member which cooperates with the current carrying contacts to open and close the circuit;

arc dissipation areas provided in the protection chamber of the interior compartment, the arc dissipation chambers located proximate to the current carrying contacts;

arcuate magnets provided proximate the arcuate end walls of the dissipation areas and proximate the current carrying contacts, the arcuate magnets do not reduce the contact force applied between the coupling member and the contact carrying contacts when the circuit is closed;

the arcuate magnets create magnetic flux or a magnetic field that extends across the current carrying contacts, the magnetic flux from the arcuate magnets directs electric arcs radiating from one or more of the current carrying contacts into the arc dissipation areas, thereby increasing the effective distance that the electric arcs travel wherein the electric arcs are dissipated in the dissipation areas.

2. The contactor assembly of claim 1, wherein the magnets are inserted and maintained in magnet receiving recess formed between an inner housing of the contactor and an outer housing of the contactor.

3. The contactor assembly of claim 1, wherein the magnets are permanent magnets.

4. The contactor assembly of claim 1, wherein the magnets are electromagnets.

5. The contactor assembly of claim 1, wherein the magnetic flux from the magnets directs the electric arcs in a path approximating a parabola.

6. The contactor assembly of claim 1, wherein the magnets are inserted and maintained in magnet receiving recess, wherein the electric arc does not directly contact the magnets, allowing the magnets to retain their magnetic properties to achieve stable performance.

7. A switch assembly adapted for switching power to a circuit having a power source, the switch assembly comprising:

a housing defining an interior compartment and including internal walls that laterally extend within the interior compartment to define a protection chamber, end walls of the protection chamber having an arcuate configuration;

current carrying contacts disposed in the protection chamber of the housing, the current carrying contacts including conductive bodies that protrude from the housing and are configured to close the circuit;

an actuator assembly having a coupling member which cooperates with the current carrying contacts to open and close the circuit arc dissipation areas provided in the protection chamber of the interior compartment, the arc dissipation chambers located proximate to the current carrying contacts;

arcuate magnets provided proximate the arcuate end walls of the dissipation areas and proximate the current carrying contacts, the arcuate magnets do not reduce the contact force applied between the coupling member and the contact carrying contacts when the circuit is closed;

the arcuate magnets create magnetic flux or a magnetic field that extends across the current carrying contacts, the magnetic flux from the arcuate magnets directs electric arcs radiating from one or more of the current carrying contacts into the arc dissipation areas, wherein paths of the electric arcs approximate a parabola, thereby effectively increasing the distance that the arcs must travel.

8. The switch assembly of claim 7, wherein the magnets are inserted and maintained in magnet receiving recess formed between an inner housing of the contactor and an outer housing of the contactor.

9. The switch assembly of claim 7, wherein the magnets are permanent magnets.

10. The switch assembly of claim 7, wherein the magnets are electromagnets.

11. The switch assembly of claim 7, wherein the magnets are inserted and maintained in magnet receiving recess, wherein the electric arc does not directly contact the magnets, allowing the magnets to retain their magnetic properties to achieve stable performance.

12. A switch assembly adapted for switching power to a circuit having a power source, the switch assembly comprising:

a housing defining an interior compartment and including internal walls that laterally extend within the interior compartment to define a protection chamber, end walls of the protection chamber having an arcuate configuration;

a pair of current carrying contacts disposed in the protection chamber of the housing, the current carrying contacts including conductive bodies that protrude from the housing and are configured to close the circuit;

an actuator assembly having a coupling member which cooperates with the current carrying contacts to open and close the circuit a pair of arc dissipation areas provided at opposite ends of the protection chamber of the interior compartment, the arc dissipation chambers located proximate to the current carrying contacts;

a pair of arcuate magnets provided proximate the arcuate end walls of the dissipation areas and proximate the current carrying contacts, the pair of arcuate magnets do not reduce the contact force applied between the coupling member and the contact carrying contacts when the circuit is closed;

each arcuate magnet creates magnetic flux or a magnetic field that extends across a respective current carrying contact, the magnetic flux from the each arcuate magnet directs an electric arc radiating from the respective current carrying contact into a respective arc dissipation area, thereby increasing the effective distance that the electric arc travels wherein the electric arc is dissipated in the respective dissipation area.

13. The switch assembly of claim 12, wherein the pair of magnets are inserted and maintained in a pair of magnet receiving recesses formed between an inner housing of the contactor and an outer housing of the contactor, the pair of magnet receiving recesses isolates the pair of magnets from the interior compartment, wherein the electric arcs do not directly contact the pair of magnets, allowing the pair of magnets to retain their magnetic properties to achieve stable performance.

14. The switch assembly of claim 13, wherein the magnetic flux from the pair of magnets directs the electric arcs in a path approximating a parabola.

15. The switch assembly of claim 13, wherein the pair of magnets are permanent magnets.

16. The switch assembly of claim 13, wherein the pair of magnets are electromagnets.

* * * * *